United States Patent [19]

Young

[11] Patent Number: 4,945,834

[45] Date of Patent: Aug. 7, 1990

[54] EXPLOSIVE PROJECTILES

[75] Inventor: Frederick M. Young, Chorley, England

[73] Assignee: Royal Ordnance plc, London, England

[21] Appl. No.: 328,780

[22] Filed: Mar. 27, 1989

Related U.S. Application Data

[63] Continuation of Ser. No. 161,230, Feb. 17, 1988, abandoned, which is a continuation of Ser. No. 915,758, Oct. 6, 1986, abandoned.

[30] Foreign Application Priority Data

Oct. 22, 1985 [GB] United Kingdom ..... 8526046

[51] Int. Cl.[5] ..... F42B 12/00

[52] U.S. Cl. ..... 102/473; 102/293; 102/499

[58] Field of Search ..... 102/200, 204, 266, 272, 102/293, 346, 342, 351, 352, 396, 473, 481, 487, 488, 499, 500, 505; 86/20.14

[56] References Cited

U.S. PATENT DOCUMENTS

| | | | |
|---|---|---|---|
| 1,296,169 | 3/1919 | Dingwall et al. | 102/499 |
| 1,296,170 | 3/1919 | Dingwall et al. | 102/499 |
| 3,156,076 | 11/1964 | Origoni et al. | 86/20.14 |
| 3,159,076 | 12/1964 | Meissner | 86/20.14 |
| 3,705,552 | 12/1972 | Lerman | 102/487 |
| 4,365,556 | 12/1982 | Reibel | 102/307 |
| 4,383,470 | 5/1983 | Assmann | 102/487 |
| 4,567,830 | 2/1986 | Apotheloz | 102/266 |

FOREIGN PATENT DOCUMENTS

| | | | |
|---|---|---|---|
| 502477 | 5/1920 | France | 102/473 |
| 1086282 | 2/1955 | France . | |
| 106837 | 6/1917 | United Kingdom | 102/473 |
| 270642 | 3/1928 | United Kingdom | 102/272 |
| 576544 | 4/1946 | United Kingdom . | |
| 1396270 | 6/1975 | United Kingdom . | |

*Primary Examiner*—Harold J. Tudor

*Attorney, Agent, or Firm*—Stevens, Davis, Miller & Mosher

[57] ABSTRACT

An explosive projectile comprises a casing, having a neck shaped portion adjacent to the opening, a female screw thread being formed in the internal wall of the neck shaped portion, and a region of increased average internal diameter in its inner wall beyond the screw thread, a charge of high explosive material partially filling the space inside the casing, and a case located between the charge and the neck shaped portion the case defining a detonation device cavity, the case being made of a malleable material and being swaged into the neck shaped portion and into part of the region of the internal wall of the casing which has an increased average internal diameter.

6 Claims, 2 Drawing Sheets

EXPLOSIVE PROJECTILES

Figure 1:
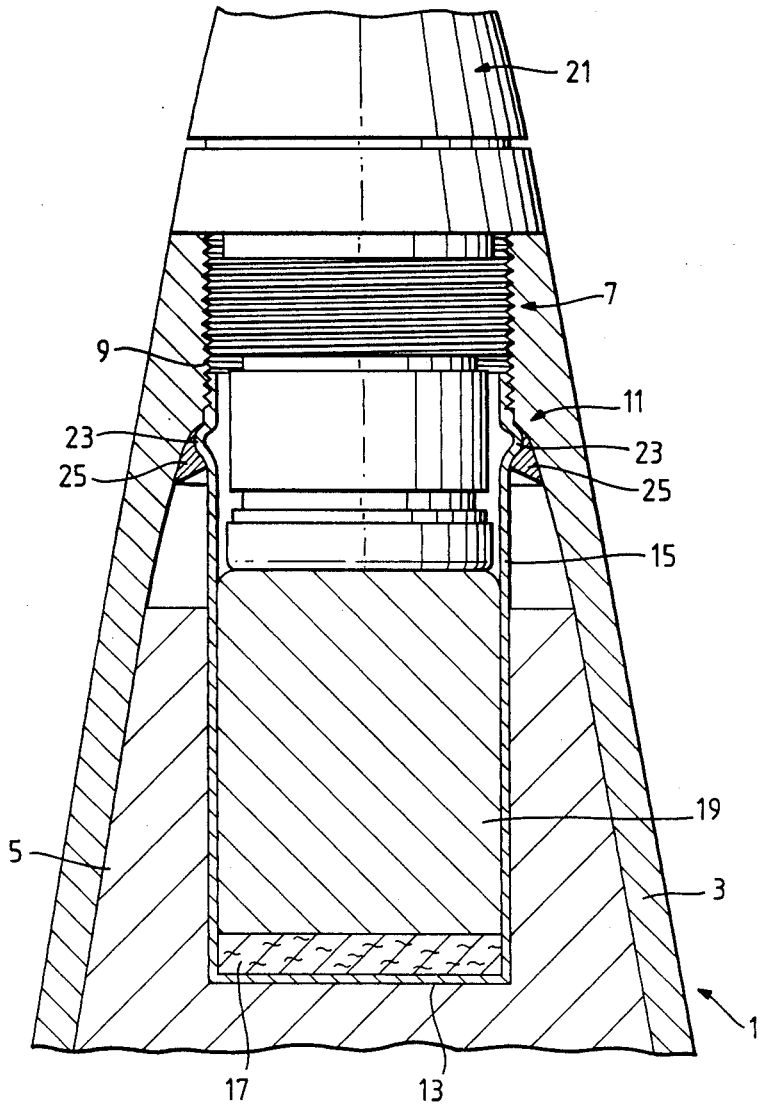

This application is a continuation of application Ser. No. 161,130, filed Feb. 17, 1988, now abandoned, which in turn is a continuation of application Ser. No. 915,758 filed Oct. 6, 1986, now abandoned. The present invention relates to explosive projectiles.

It has been known for many years to manufacture high explosive projectiles which comprise a type of explosive shell in various ways, one of which is that described as follows. A metal casing having an open upper end and a closed lower end forming a container is partially filled with high explosive material in a hot liquid state which is allowed to solidify by cooling or by pressing powder into a solid state inside the casing. A detonator booster cavity is later machined in the upper surface of the solid explosive charge so formed into which is inserted a cardboard liner, projecting above the charge.

The gap above the explosive charge between the wall of the casing and the liner of the booster cavity is then sealed with a bituminous composition which is applied in a soft mastic state and kneaded by a hand-worked operation to occupy the corners of the gap and to adhere to and coat the adjoining surfaces of the casing, the liner and the explosive charge.

A detonator booster device is inserted in the cavity and finally a fuze is fitted into the nose of the shell. In operation the fuze interacts with the booster device to provide the required detonation of the explosive charge.

During their service life high explosive shells may be subjected to extreme environmental conditions, particularly high and low temperatures, and rough use eg. drop, bounce, vibration, topple etc. These conditions can cause the explosive charge to crack and powder. High temperatures can cause expansion and even melting of the charge. The bituminous composition seal is applied as described above to seal in the explosive charge to prevent it being contaminated by atmospheric moisture and other substances and to prevent the explosive material entering the fuze cavity region.

Explosive charge material entering this region is regarded as a serious safety hazard. The fuze is normally fitted in the shell caging by a screw thread joint. If the explosive charge material becomes trapped between the threads of the fuze screw thread joint it may be initiated by (a) removing the fuze (eg. for inspection purposes) or (b) acceleration of the shell on firing which can cause compression of the explosive material between the screw threads. Such initiation can cause uncontrolled premature detonation of the main explosive charge.

Explosive shells manufactured by the known method described above suffer from serious sealing problems. It has been found that the bituminous sealant material does not adequately contain the explosive material in all circumstances.

In cold conditions the bituminous material becomes very brittle and the seal is likely to crack and break down allowing explosive material to escape. The sealant particles themselves are a hazard since the friction caused by their relative movement could itself trigger an unwanted detonation. In hot conditions the sealant material softens and fails to contain the explosive material in some cases. It has been found, for instance, that a known explosive composition containing TNT and RDX which starts to soften at about 63° C. and is in a flowable state above 73° C. exudes past the sealant material not only into the fuze cavity area but also onto the outer surface of the shell body where it is extremely hazardous. As a result, the bituminous material is unsuitable as a sealant for use over a range of climatic conditions.

Considerable effort in this field has been put into solving these problems but no satisfactory solution has been found hitherto. Much of this effort has been directed at improving the bituminous sealant material.

Another technique which has been investigated is to seal the cavity between the booster cavity liner and the casing wall with a polyurethane resin deposited in the gap in a softened uncured state to form an adhesive sealant coating similar to that of the bituminous material. This technique suffers from the disadvantages that uniform consistency of sealant polymer is difficult to achieve, access to the explosive charge, which may be necessary for inspection purposes in certain circumstances, it is not easily obtained through the sealant once set and polyurethane technology is relatively dangerous because of the toxic vapours which may be produced in the chemical reactions involved in the curing process.

According to the present invention in a first aspect an explosive shell comprises a casing, having an opening, a neck shaped portion adjacent to the opening, a female screw thread being formed in the internal wall of the neck shaped portion, and a region of increased average internal diameter in its inner wall beyond the screw thread, a charge of high explosive material partially filling the space inside the casing, a case located between the charge and the neck shaped portion the case defining a detonation device cavity, the case being made of a malleable material and being swaged into the neck shaped portion and into part of the region of the internal wall of the casing which has an increased average internal diameter.

The case, which may be in the form of a canister, may be made of aluminium or an aluminium alloy.

The case, swaged into the inner wall of the casing of the shell as described, provides an improved seal for the high explosive material compared with that used in the known methods described above. It is to be noted that swaging the canister into the neck shaped portion alone does not provide an adequate solution to the sealing problem. However, extending the swaging into the region of increased internal diameter provides a fold which will help to absorb any axial shock and also provides a larger area of contact thus avoiding radial loading. Such swaging provides an effective barrier to high explosive material entering the region of the female screw thread into which a fuze unit bearing a male screw thread is fitted (after insertion of a detonator booster in the cavity defined by the case) to close the opening of the shell casing.

Nevertheless, the swaging may extend into the female screw thread of the neck shaped portion.

A circular groove or recess may be provided, eg. by machining, in the inner wall of the casing between the female screw thread and the region of increased internal diameter, and the casing is swaged into the groove or recess to facilitate formation of the swaged joint.

Alternatively, or in addition, a circular lip may be formed in the inner casing wall, eg. between the circular groove or recess (where present) and the region of increased average internal diameter, and the case is swaged around the lip to facilitate formation of the swaged joint.

A ring of sealant material, eg. a room temperature vulcanising material, eg. an epoxy resin or silicone material, may be provided on the inner casing wall at the junction between the case and the casing to assist the sealing function of the swaged joint.

If the booster device is contained in a metal canister the canister preferably has soft tape or other adhesive material on its outer surface to avoid metal-to-metal contact (and hence possible friction) with the case.

The high explosive may comprise a composition containing TNT(2,4,6-trinitrotoluene) eg. together with RDX (cylcotrimethylene trinitramine).

Known additives such as hexanitrostilbene and wax may be added in small quantities as described in UK Patent No. 1,249,038.

The inner wall of the shell may be lined with a suitable paint or lacquer prior to introduction of the high explosive charge, eg. as described in UK Patent No. 1,295,486.

The shell according to the present invention may be any gun fired shell, eg. an artillery shell, and may for example, be any suitable calibre above 30 mm, eg. 76 mm, 105 mm, 4.5 inches or especially 155 mm.

According to the present invention in a second aspect a method of sealing a charge of high explosive material in a shell as defined in the first aspect includes the steps of partially filling the shell with a charge of high explosive material, and swaging a case made of a malleable metallic material into the neck shaped portion of the casing of the shell and into part of the region of the internal wall of the casing which has an increased average internal diameter.

A ring of sealant material may be located on the inside wall of the casing prior to insertion and swaging of the case whereby the ring internally seals the junction between the case and the casing.

The swaging step may be carried out in any known way, eg. by forcing an expanding collet into split portions having formations complementary to the adjacent internal wall of the shell. For example, where the case is to be swaged into the female screw thread the split portions define a complementary male screw thread Likewise, where the case is to be swaged into an annular recess the split portions define a complementary annular lip.

The surface of the high explosive charge may be machined, prior to insertion and swaging of the case, to form an aperture into which the base of the case fits to locate the case.

Figure 2:
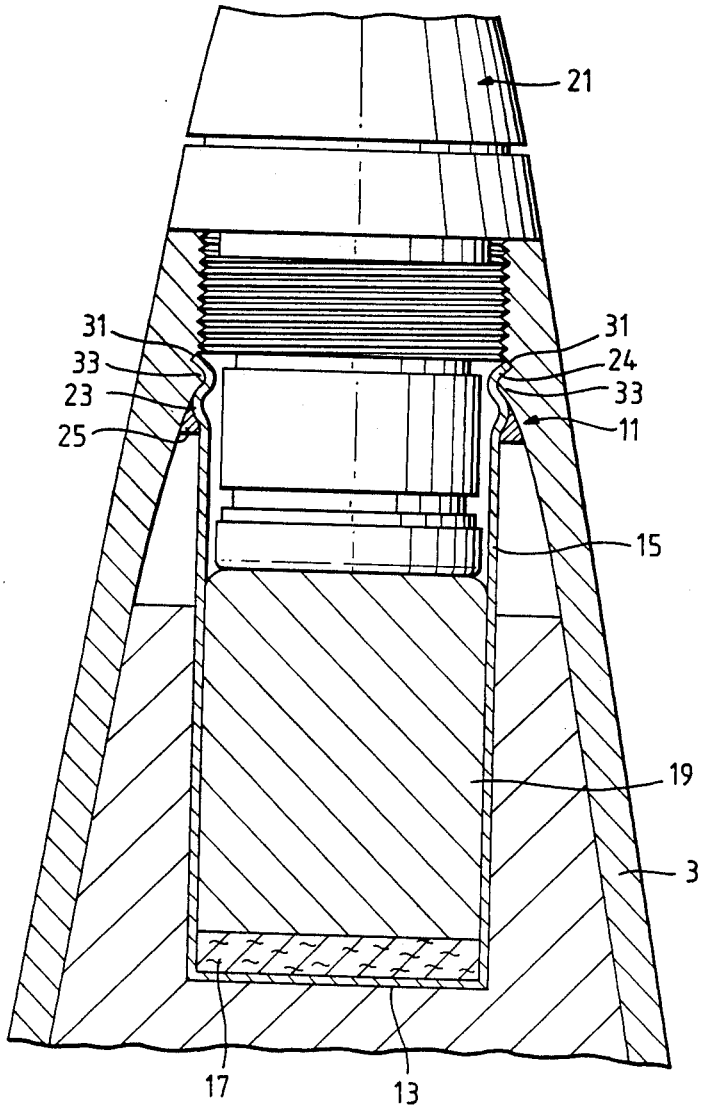

A cushioning layer, eg. of woollen felt may be located between the base of the case and the charge of high explosive material. Embodiments of the present invention will now be described by way of example with reference to the accompanying drawings, in which:

FIG. 1 is a partly cross-sectional front elevation of part of an explosive shell;

FIG. 2 is a partly cross-sectional front elevation of part of an explosive shell illustrating an alternative sealing construction In FIG. 1 a shell 1 having a casing 3, eg. made of high tensile steel, is partially filled with a charge 5 of high explosive material comprising the known composition manufactured according to the UK Ministry of Defence service use designation RDX/TNT Type G (CW3), a composition comprising RDX and TNT in the ratio by weight 60:40, plus additives. The casing 3 has a neck shaped portion 7 providing an upper opening for filling the shell 1. A female screw thread 9 is machined in the neck shaped portion 10. The internal wall of the casing 3 has a diameter which begins to increase beneath the neck shaped portion 10. The internal wall of the casing 3 has a diameter which begins to increase beneath the neck shaped portion in region 11. An aperture 13 is machined in the top surface of the charge 5 and a cup shaped case 15 made of aluminium or aluminium alloy is seated in the aperture 13 on a felt cushioning layer 17. A conventional detonator booster 19 (exploder) is deposited in the case 15 and a conventional fuze unit 21 is screwed into the casing 3 at the screw thread 9 to close the upper opening provided by the neck shaped portion 10. The fuze unit 21 is screwed into the casing 3 at the screw thread 9 to close the upper opening provided by the neck shaped portion 10. The fuze unit 21 and the booster 19 act in conjunction to provide a controlled detonation of the charge 5 at the required instant in time.

The high explosive material of the charge 5 is sealed to prevent contamination of the neck shaped portion, especially the fuze unit 21 and the screw thread 9, in the following way. Prior to insertion of the booster 19 and the fuze unit 21 the case 15 is swaged into the lower portion of the screw thread 9 and also into the inner wall of the casing 3 at the upper part of the enlarged region 11 thereby forming a kink 23 in the case 15. A ring 25 of sealant material deposited on the inner wall of the casing 3 at the region 11 provides an additional seal between the junction of the case 15 and casing 3.

In FIG. 2 parts which are the same as those shown in FIG. 1 have the same reference numerals. In FIG. 2 a purpose-made groove 31 is machined into the casing 3 immediately beneath the thread 9 and a circular lip 33 is formed beneath the groove 31. In this example, the case 15 is swaged into the inner wall of the casing 3 in a region which includes and extends between, the groove 31, the lip 33 and the upper part of the enlarged region 11. In this example two kinks 23, 24 are formed in the case 15 at the swaged joint.

I claim:

1. An explosive shell comprising a shell casing having an opening in its forward end; a neck-shaped portion of the shell casing adjacent to the opening; a female screw thread formed in the internal wall of the said neck-shaped portion; an enlarged region of the internal wall of the shell casing rearward of and distinct from the said neck-shaped portion, said enlarged region having an average internal diameter greater than the internal diameter of the said screw thread; a charge of high explosive material partially filling the space inside the shell casing; and a booster case located between the charge and the neck-shaped portion, the booster case defining a detonation device cavity, the booster case being a malleable material and being swaged into the internal wall of the neckshaped portion of the shell casing and into at least a part of the said enlarged region of the internal wall of the shell casing.

2. A shell as claimed in claim 1 and wherein the case is in the form of a canister made of aluminium or aluminium alloy.

3. A shell as claimed in claim 1 and wherein the case is swaged into part of the said female screw thread.

4. A shell as claimed in claim 1 and wherein a circular groove or recess is formed in the said neck shaped portion between the female screw thread and the region of increased average internal diameter in the casing inner wall and the casing is swaged into the groove or recess.

5. A shell as claimed in claim 1 and wherein a circular lip is formed in the inner casing wall in the necked portion and the case is swaged around the lip.

6. A shell as claimed in claim 1 and wherein a ring of sealant material is provided on the inner casing wall at the junction between the case and the casing.

* * * * *